US006566813B1

(12) United States Patent
Lehmann et al.

(10) Patent No.: US 6,566,813 B1
(45) Date of Patent: May 20, 2003

(54) OVERVOLTAGE PROTECTION DEVICE WITH CONCENTRIC ARCING HORNS

(75) Inventors: Eberhard Lehmann, Kiel (DE); Klaus Scheibe, Kiel (DE); Joachim Schimanski, Detmold (DE); Jörg Tews, Grebin (DE); Martin Wetter, Detmold (DE)

(73) Assignee: Phoenix Contact GmbH & Co., Blomberg (DE)

( * ) Notice: Subject to any disclaimer, the term of this patent is extended or adjusted under 35 U.S.C. 154(b) by 0 days.

(21) Appl. No.: 09/519,423

(22) Filed: Mar. 6, 2000

(30) Foreign Application Priority Data

Mar. 4, 1999 (DE) ..... 199 09 378
Mar. 29, 1999 (DE) ..... 199 14 312
Oct. 27, 1999 (DE) ..... 199 51 857

(51) Int. Cl.[7] ..... H01T 4/14

(52) U.S. Cl. ..... 313/621; 313/231.11; 313/231.21; 313/231.41; 361/118; 361/120; 361/127

(58) Field of Search ..... 313/602, 621, 313/231.21, 231.41, 625, 619, 325, 326, 238–244, 231.11; 361/117, 118, 120, 127–130

(56) References Cited

U.S. PATENT DOCUMENTS 2,628,322 A * 2/1953 Yonkers ..... 313/231
3,064,156 A * 11/1962 Pittman ..... 313/231
4,056,753 A * 11/1977 Keikichi et al. ..... 313/306
4,546,402 A * 10/1985 deSouza et al. ..... 313/306
5,224,013 A * 6/1993 Pagliuca ..... 337/32
5,604,400 A 2/1997 Altmaier et al. ..... 313/621
5,754,385 A * 5/1998 Altmaier et al. ..... 361/111
5,768,082 A * 6/1998 Lange et al. ..... 361/112

FOREIGN PATENT DOCUMENTS

DE 3101354 A1 * 8/1982 ..... H01T/3/00
DE 44 02 615 12/1994 ..... H01T/1/20
DE 196 04 947 C1 7/1997 ..... H01T/1/10

* cited by examiner

*Primary Examiner*—Nimeshkumar D. Patel
*Assistant Examiner*—Sikha Roy
(74) *Attorney, Agent, or Firm*—Nixon Peabody LLP; David S. Safran

(57) ABSTRACT

An overvoltage protection device (1) with a first electrode (2) which has a first arcing horn (3), with a second electrode (4) which has a second arcing horn (5), with an air-breakdown spark gap (6) which is active between the arcing horns (3, 5), and with a housing (7) which accommodates the electrodes (2, 4), has the two arcing horns (3, 5) shaped and arranged relative to one another such that they diverge from a lower ignition area (8) to their outer ends (9, 10), so that the air-breakdown spark gap (6) widens outwardly, proceeding from the ignition area (8). The overvoltage protection device (1) has a current carrying capacity which is as high as possible and a high network follow current extinction capacity with an overall height which is as small as possible by the first arcing horn (3) being made in the shape of a truncated cone and the second arcing horn (5) being located concentrically around the first arcing horn (3).

28 Claims, 6 Drawing Sheets

OVERVOLTAGE PROTECTION DEVICE WITH CONCENTRIC ARCING HORNS

BACKGROUND OF THE INVENTION

1. Field of the Invention

The invention relates to an overvoltage protection device with a first electrode which has a first arcing horn, with a second electrode which has a second arcing horn, with an air-breakdown spark gap which is active between the arcing horns, and with a housing which accommodates the electrodes, the two arcing horns being made and arranged relative to one another such that they diverge from a lower ignition area each to their outer ends, so that the air-breakdown spark gap widens to the outside, proceeding from the ignition area.

2. Description of Related Art

Electrical, but especially electronic measurement, control and switching circuits, mainly also telecommunications means and systems, are sensitive to transient overvoltages, as can occur especially by atmospheric discharges, but also by switching operations and short circuits in power supply grids. This sensitivity has increased to the extent that electronic components, especially transistors and thyristors, are used; mainly integrated circuits which are being increasingly used are greatly endangered by transient overvoltages.

To protect electrical, but especially electronic measurement, control and switching circuits, mainly also telecommunications means and systems, against transient overvoltages, generally, wherever electronic circuits are used, overvoltage protection devices have been developed and used for more than twenty years.

One important component of an overvoltage protection device is at least one spark gap which operates at a certain overvoltage, the operating voltage, and thus, prevents overvoltages which are greater than the operating voltage of the spark gap from occurring in the area protected by this overvoltage protection device.

It was mentioned at the start that the type of overvoltage protection device to which the invention is directed has two electrodes and an air-breakdown spark gap which acts between the electrodes or their arcing horns. In addition to overvoltage protection devices with an air-breakdown spark gap, there are overvoltage protection elements with an air-flashover spark gap in which a creeping discharge occurs upon response. Overvoltage protection devices with an air-breakdown spark gap, as compared to overvoltage protection devices with an air-flashover spark gap, have the advantage of higher current carrying capacity, but the disadvantage of a higher and not especially constant operating voltage. Therefore, various overvoltage protection devices with an air-breakdown spark gap have been proposed which have been improved with reference to the operating voltage. Here, in the area of the arcing horns or the air-breakdown spark gaps which act between the arcing horns, ignition aids have been accomplished in various ways, for example, such that there was at least one ignition aid between the arcing horns which triggers a creeping discharge and which projects partially into the air-breakdown spark gap, the ignition aid being made in the manner of a bridge of plastic.

The overvoltage protection device upon which the present invention is based is known from German Patent DE 44 02 615 C 2 and corresponding U.S. Pat. No. 5,604,400. The known overvoltage protection device has two narrow electrodes which are each made angled and each have an arcing horn and a terminal leg bent away from it. The known overvoltage protection device is characterized in that, based on the electrodes which extend more or less in one plane, it has only a small overall width. Furthermore, the known overvoltage protection device, in any case, when operated for the first time, has a high current carrying capacity and high network follow current extinction capacity. However, problems always arise when an arc jams at one location; this can lead to electrode damage.

Furthermore, German Patent DE 196 04 947 C 1 discloses an overvoltage protection device which is made essentially rotationally symmetrical. The two electrodes are identical and each have arcing horns in the shape of truncated cones, and an ignition bridge for triggering a creeping discharge is located between the two end faces of the arcing horns. This known overvoltage protection device is likewise characterized by high current carrying capacity and a high network follow current extinction capacity. However, the disadvantage is that this known overvoltage protection device has a relative high overall height. Another disadvantage is that, when the spark gap operates, considerable forces act on the extremely sensitive ignition bridge; this can lead to the ignition bridge being damaged.

SUMMARY OF THE INVENTION

A primary object of this invention is, therefore, to devise an overvoltage protection device of the type mentioned above which is characterized by a high current carrying capacity and high network follow current extinction capacity with an overall height which is as small as possible.

The overvoltage protection device as in accordance with the invention, in which the aforementioned object is achieved, first of all, is essentially characterized by the first arcing horn being made in the shape of a truncated cone and the second arcing horn being located concentrically around the first arcing horn. In accordance with the invention, the first electrode with the first arcing horn represents a middle electrode, while the second electrode with the second arcing horn represents an outer electrode. The concentric arrangement of the second arcing horn around the first arcing horn yields a horn spark gap which runs entirely or partially around the center axis of the two electrodes. This yields a peripherally closed spark gap when the second arcing horn is made circular and the surface of the second arcing horn facing the first arcing horn is made in the shape of a truncated funnel.

However, basically, it is also possible to make the second arcing horn such that it has a plurality of arcing horn segments which are spaced apart from one another and arranged concentrically around the first arcing horn. One especially preferred embodiment of the overvoltage protection device according to the invention is provided with a second arcing horn which is made in the shape of a ring segment and the surface of the second arcing horn facing the first arcing horn is made in the shape of a truncated funnel. Preferably, the second arcing horn extends over an angle of roughly 210° to 270°, especially over an angle of roughly 240°. The embodiment of the overvoltage protection device in accordance with the invention in which the second arcing horn is made in the shape of a ring segment is one in which there is a horn spark gap which extends only partially around the center axis of the two electrodes.

In the overvoltage protection device according to the invention, the horn spark gap which runs only partially around the center axis of the electrodes is characterized by a very high current carrying capacity and a, likewise, high network follow current extinction capacity. Furthermore, the concentric arrangement of the second arcing horn around the first arcing horn yields a very low overall height of the overvoltage protection device and a simple structure.

A preferred embodiment of the overvoltage protection device as in accordance with the invention, furthermore, has at least one ignition bridge of electrically insulating material in the ignition area between the two arcing horns. Via the ignition bridge, a creeping discharge is triggered which, once initiated, at a relatively constant, low operating voltage, leads to ignition of the air-breakdown spark gap with a relatively high current carrying capacity. Since, in the overvoltage protection device of the present invention, in contrast to the overvoltage protection device known from German Patent DE 196 04 947 C 1, the spark gap is open in the axial direction instead of the radial direction, the mechanical forces acting on the extremely sensitive ignition bridge are minimized when the spark gap is operated. So that a creeping discharge is possible anywhere on the entirely or partially peripheral horn spark gap, the ignition bridge is made ring-shaped; therefore, like the second arcing horn, it is arranged concentrically around the first arcing horn. Preferably, the ignition bridge is made of a plastic which evolves an arc extinguishing gas when heated. This improves the extinction behavior of the overvoltage protection device after operating.

The overvoltage protection device in accordance with the invention, as is conventional, has a first terminal area and a second terminal area. Preferably, it is provided in this connection that the first terminal area and the second terminal area are located on the same side of the overvoltage protection device. This yields the advantage that, in the case of operation, the electromagnetic forces which act on the arc support its continued movement from the ignition area into the widened horn area.

The last described embodiment of the overvoltage protection device according to the invention, preferably, also has holes and/or through openings in the terminal areas of the electrodes and there are terminal elements which extend above and beyond the terminal areas, specifically a PE terminal element and a potential terminal element, and preferably in one terminal area, preferably in the terminal area provided for the potential terminal element, there are two connection possibilities. Therefore, in this embodiment, there need not necessarily be terminal elements which are integrated into the overvoltage protection device and which project from the latter, so that overvoltage protection device can have a disk or pot shape, as it were. Of course, in this case, the electrodes must be connected to the terminal elements which can be inserted, for example, screwed in, in the region of the terminal areas. Otherwise, because there are through openings in the electrodes, venting can be easily obtained.

If, in the overvoltage protection device of the invention, as described last, the two terminal areas, and thus the two terminal elements, are on the same side, it is recommended that there be at least one bridge, which is made preferably undulating, on the outside in the region of the terminal areas to increase the creepage distance between the terminal areas. In particular, when one of the two terminal areas has two connection possibilities, it is a good idea to make the bridge undulating and to place it between the terminal areas.

It has already been stated above that one especially preferred embodiment of the overvoltage protection device in accordance with the invention has the second arcing horn made in the shape of a ring segment. In this embodiment, it is recommended that the second arcing horn be aligned to the second terminal area, and thus, to the potential terminal element. This means then that the recess which the second arcing horn has is aligned relative to the first terminal area, and thus, to the PE terminal element.

The preferred embodiment of the overvoltage protection device according to the invention which was described last preferably also has the potential terminal element on the side of the two electrodes which is opposite the PE terminal element, and preferably, at least the second electrode, and thus the second arcing horn, but preferably both electrodes, and thus the two arcing horns, are made and arranged symmetrically with reference to the PE terminal element.

Otherwise, a further improved network follow current extinction capacity in the overvoltage protection device of the invention arises by the housing being encapsulated pressure-tight. The pressure-tight encapsulation also makes it possible to fill the housing interior with an arc extinguishing gas; this can contribute further to improvement of the network follow current extinction capacity.

In the overvoltage protection device in accordance with the invention, the housing can have a housing bottom part and a housing cover, then preferably, the housing bottom part and the housing cover can be screwed and/or cemented to one another. Otherwise, it is provided for reasons of touch protection that the housing bottom part and the housing cover do not make contact with the first electrode or the second electrode anywhere; preferably, between the first electrode and the second electrode, on the one hand, and the housing bottom part and the housing cover, on the other hand, there is at least one insulating part and/or an air gap. If, in the overvoltage protection device according to the invention, as described above, in the ignition area between the two arcing horns, there is at least one ignition bridge for triggering a creeping discharge, then it is recommended that the ignition bridge be made in one piece with the insulating part. This minimizes the number of components of the overvoltage protection device of the invention.

Otherwise, it is recommended that the overvoltage protection device of the present invention has, to further improve the current carrying capacity and the network follow current extinction capacity, a baffle plate at a distance from the ends of the arcing horns, so that an arc runs against the baffle plate in the case of operation of the overvoltage protection device. By using a baffle plate which, like the electrodes, preferably, is made of a copper-tungsten alloy, damage of the possibly plastic housing can be precluded. Furthermore, the baffle plate influences energy conversion in the gas space. The arc is divided specifically into three parts by the baffle plate. Two arc areas and a current area form in the baffle plate. This yields two anode-cathode falls and also an overall reduced arc, since some of the current path runs in the baffle plate and produces no plasma.

In order to have available a so-called "active" ignition aid in conjunction with the overvoltage protection device of the invention, in the area of the air-breakdown spark gap and in addition to it, there is an ignition spark gap which can be actively ignited, specifically depending on the stipulated ignition voltage. Preferably, there is an ignition spark gap between an ignition electrode and one of the two electrodes, so that only one additional electrode, specifically the ignition electrode, is necessary. The ignition electrode can be easily built by its being formed by the housing and/or the baffle plate, and it then goes without saying that the housing and/or the baffle plate each is made of an electrically conductive material. Otherwise, in this connection, it must be ensured that neither the housing nor the baffle plate are in electrical contact with one of the electrodes. Of course, when there is an "active" ignition aid, there must be available a corresponding ignition circuit for the ignition spark gap.

It was stated above that, in the overvoltage protection device in accordance with the invention, a further improved network follow current extinction capacity can arise by the housing being encapsulated in a pressure-tight manner. Especially in the embodiment of the overvoltage protection device of the invention described above, in which the second arcing horn is made in the shape of a ring segment instead of being ring-shaped, it is recommended that the housing be provided with pressure equalization openings. If in the overvoltage protection device of the invention the housing is comprised of a housing bottom part and a housing cover, it is recommended that the housing bottom part and/or the housing cover, preferably the housing bottom part, be provided on its edge facing the housing cover with preferably radially running slots which act as pressure equalization openings.

In particular, there are various possibilities for embodying and developing the overvoltage protection device in accordance with the invention. In this regard, reference is made to the following description of preferred embodiments of the overvoltage protection device in conjunction with the drawings.

DETAILED DESCRIPTION OF THE INVENTION

Figure 1:
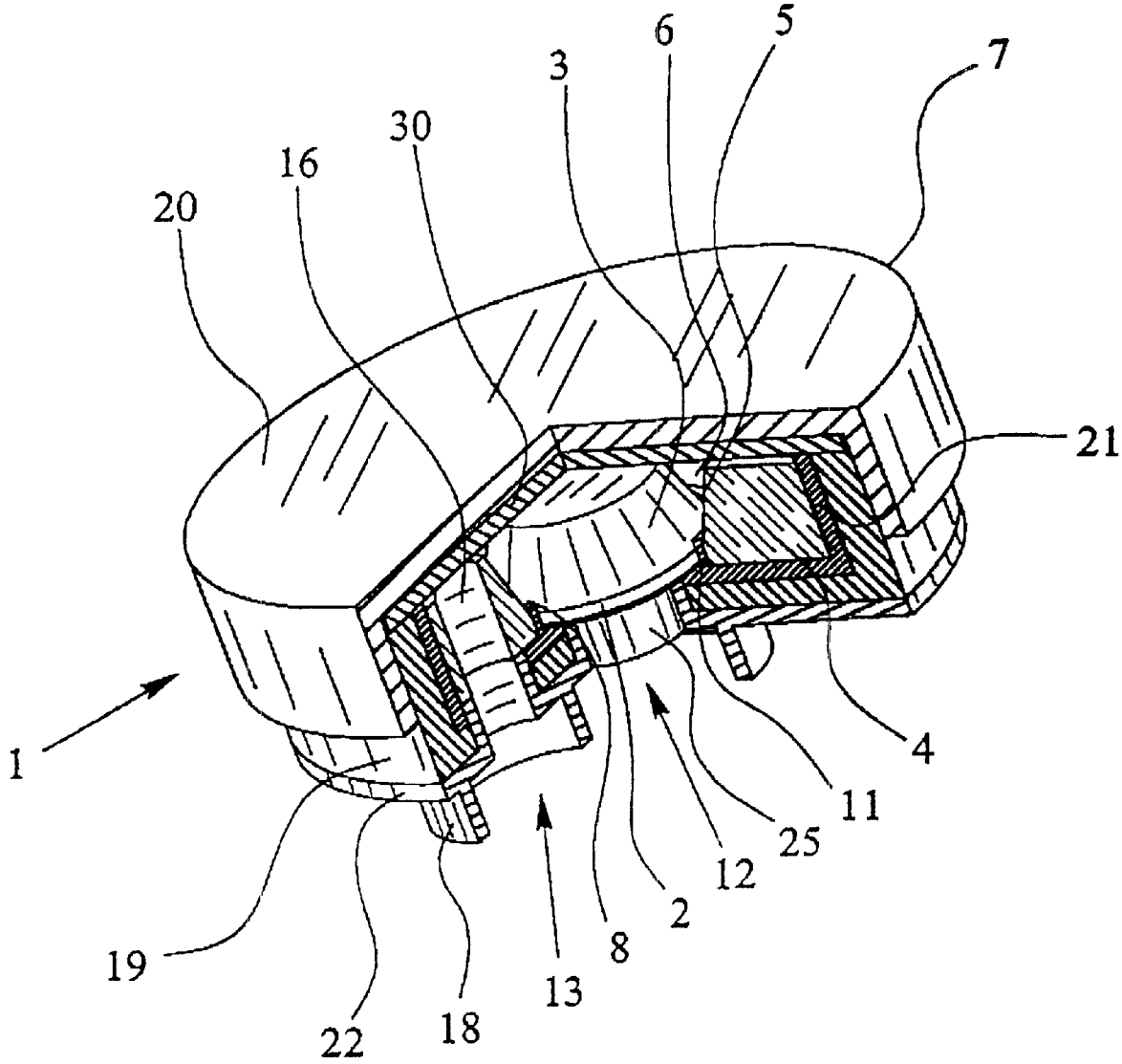
FIG. 1 is a partially cut away perspective view of a first embodiment of an overvoltage protection device in accordance with the invention.

FIGS. 1 to 5 shows an overvoltage protection device 1 which has a first electrode 2 with a first arcing horn 3 and a second electrode 4 with a second arcing horn 5. Between the first arcing horn 3 and the second arcing horn 5 there is an air-breakdown spark gap 6. Therefore, the two electrodes 2, 4 are spaced apart and are not connected to one another. Furthermore, the overvoltage protection device 1 has a housing 7 which accommodates the two electrodes 2, 4. As follows especially from FIG. 3, the two arcing horns 3, 5 are made and arranged relative to one another such that they diverge from the lower ignition area 8 of the air-breakdown gap 6 toward their outer ends 9, 10. This yields a shape of the air-breakdown spark gap 6 which continuously widens to the outside, proceeding from the ignition area 6. In this case, the air-breakdown spark gap 6 is V-shaped, the opening angle of the air-breakdown spark gap 6 being roughly 45°. In any case, even smaller opening angles (down to 10°) or even larger opening angles (up to 150°) can be utilized.

Figure 3:
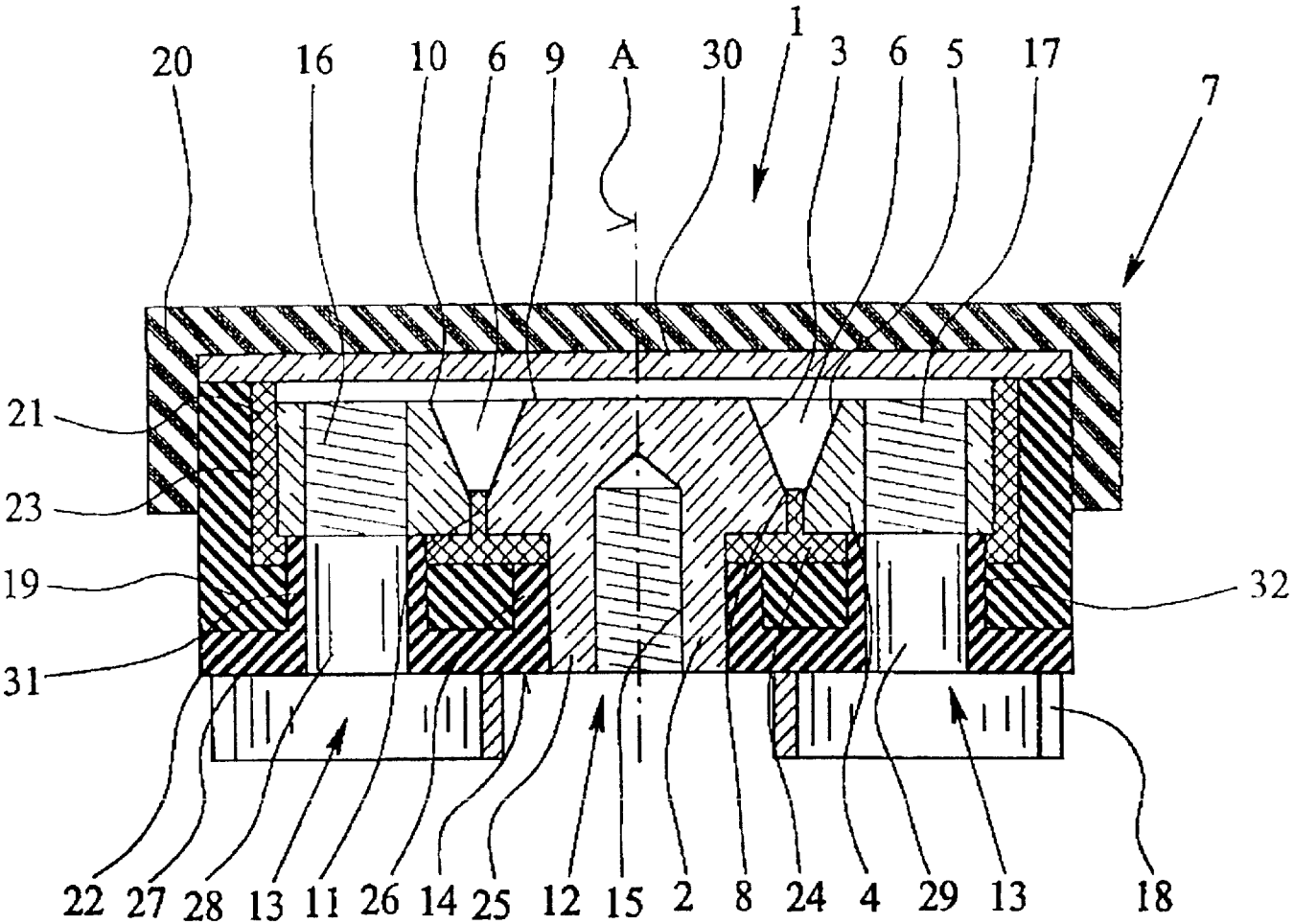
FIG. 3 is a cross section through the overvoltage protection device shown in FIGS. 1 and 2, taken along section line III—III in FIG. 5.

Here, it is important that the first arcing horn 3 is made in the shape of a truncated cone and the second arcing horn 5 is located concentrically around the first arcing horn 3. The overvoltage protection device 1, thus, has a rotationally-symmetrical structure with respect to the center axis A which is indicated in FIG. 3, the air-breakdown spark gap 6 being concentrically arranged around the center axis A and open in the axial direction due to the arrangement of electrodes 2, 4.

Figure 4:
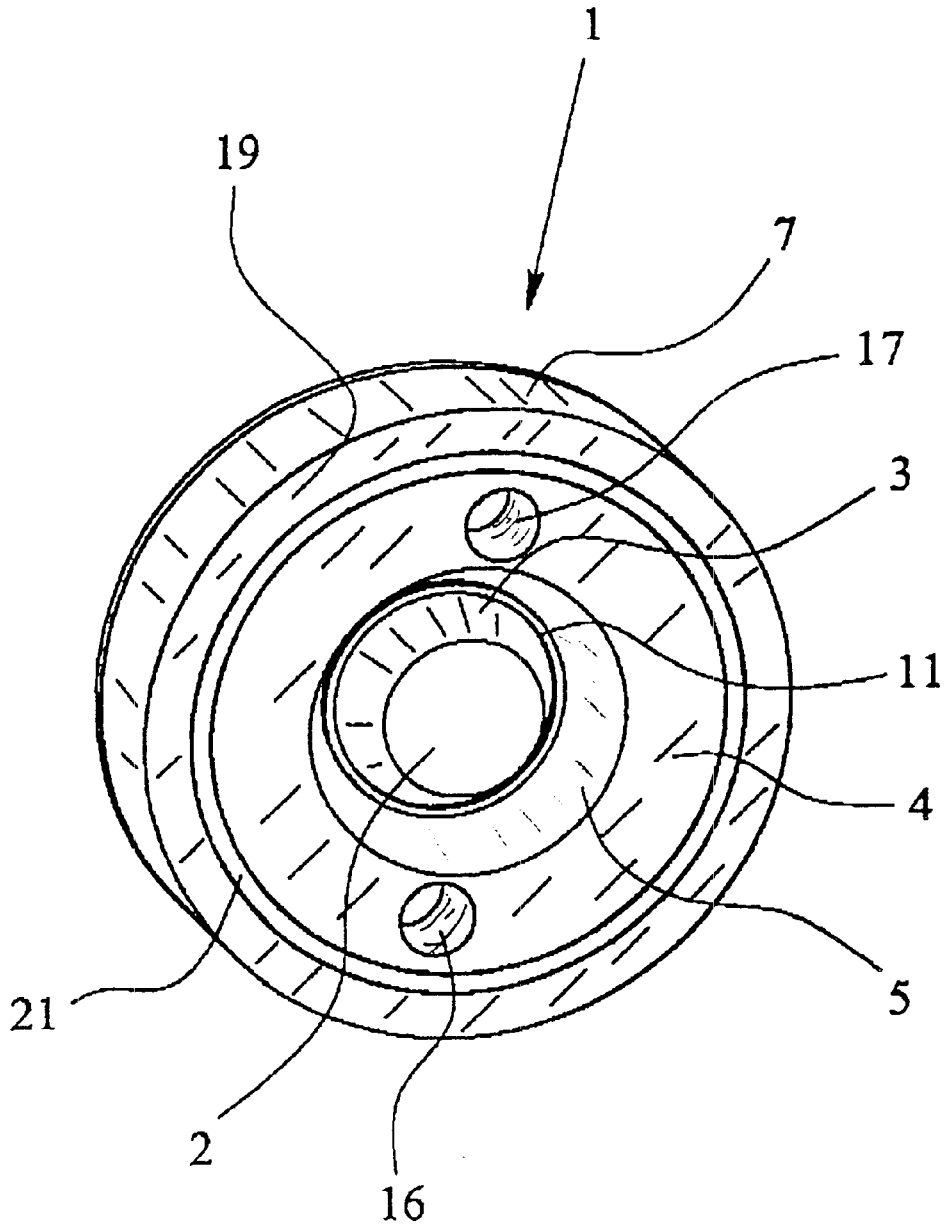
FIG. 4 is a perspective overhead view of the overvoltage protection device as shown in FIGS. 1 and 2, in the opened state.

As follows especially from FIG. 4, the second arcing horn 5 as well as the second electrode 4 are ring-shaped. To accomplish the air-breakdown spark gap 6 which widens in a V-shape in cross section, the surface of the second arcing horn 5 facing the first arcing horn 3 is made in the shape of a truncated funnel.

In the ignition area 8 of the air-breakdown spark gap 6, between the two arcing horns 3 and 5, there is an ignition bridge 11 which is used to trigger a creeping discharge. The level of the operating voltage can be adjusted over the width of the ignition bridge 11 and/or the height, i.e., over how far the ignition bridge 11 projects into the air-breakdown spark gap 6. The ignition bridge 11 itself is ring-shaped, as can be seen from FIG. 4, and is made of a plastic which evolves an arc-extinguishing gas.

As follows especially from FIGS. 1 and 3, the overvoltage protection device 1 has a first terminal area 12 and a second terminal area 13. The first terminal area 12 and the second terminal area 13 are on the same side of the overvoltage protection device 1; the side of the overvoltage protection device 11 on which the two terminal areas 12 and 13 are located is the terminal side 14. The electrode 2 in the first terminal area 12 has a hole 15 with an internal thread. The electrode 4 in the second terminal area 13 has two through openings 16, 17 which, like the hole 15, are each provided with an internal thread. Terminal elements which are not shown in FIGS. 1 to 5 can be connected to the electrodes 2 and 4 using the hole 15 and the through openings 16, 17 or using the internal thread which is formed in the hole 15 and in the through openings 16, 17.

Figure 5:
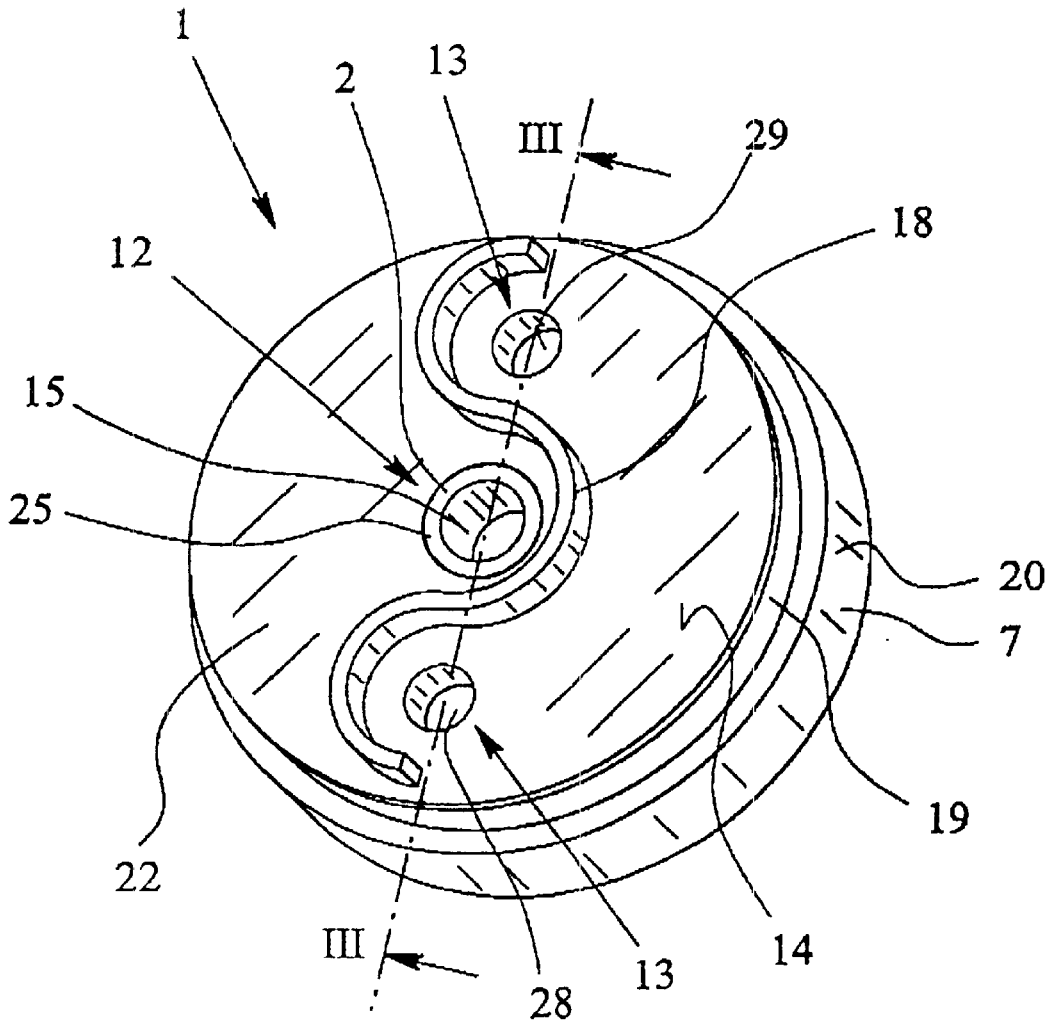
FIG. 5 is a perspective bottom view of the overvoltage protection device shown in FIGS. 1 and 2.

As follows especially from FIG. 5, on the terminal side 14 of the overvoltage protection device 1, in the region of the terminal areas 12, 13, there is at least one projecting bridge 18 for enlarging the creepage distance between the terminal areas 12, 13. The bridge 18 has a wave shape and separates the terminal areas 12, 13 from one another.

Although not apparent from FIGS. 1 to 5 in particular, the housing 7 is sealed in a pressure-tight manner and is filled with an arc extinguishing gas. The housing 7 itself, which can be made both of an electrically insulating and also an electrically conductive material, has a housing bottom part 19 and a housing cover 20. Both components have a circular shape and are cemented to one another.

Otherwise, it is provided that the housing bottom part 19 and housing cover 20 do not make contact with the first electrode 2 or the second electrode 4 anywhere. For this purpose, there are a first insulating part 21 and a second insulating part 22 and corresponding air gaps. The first insulating part 21 has a peripheral wall segment 23 which separates the second electrode 4 from the housing bottom part 19 in the peripheral direction. The wall segment 23 projects from a plate-shaped segment 24 on which the second electrode 4 rests. In addition, a part of the first electrode 2 also rests on the plate-shaped segment 24. Otherwise, the ignition bridge 11 is formed by the first insulating part 21. The ignition bridge 11 is, therefore, made in one piece with the first insulating part 21. The second insulating part 22 is located between a pin 25 of the first electrode 2 and the housing bottom part 19. Moreover, the outside of the second insulating part 22 also forms the terminal side 14 of the overvoltage protection device 1. In particular, the second insulating part 22 has a peripheral wall segment 26 which adjoins the center pin 25 of the first electrode 2 and which is bent away from a plate-shaped segment 27 with its outside forming the terminal side 14.

Otherwise, it goes without saying that both in the housing bottom part 19 and also in the two insulating parts 21, 22, there are openings 28, 29 which correspond to the through openings 16, 17 in the second electrode 4 and via which the terminal elements (not shown) can be screwed into the through openings 16, 17.

Figure 2:
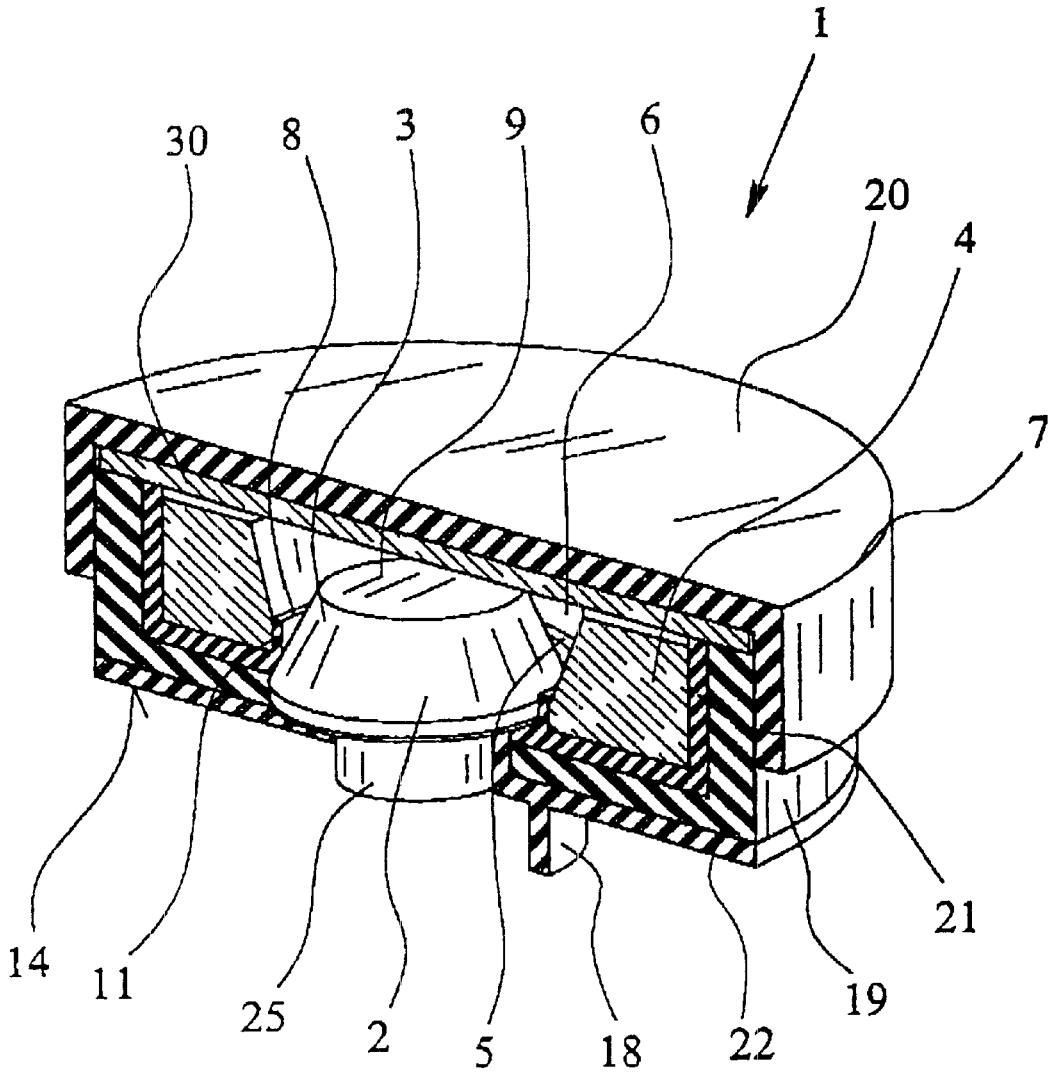
FIG. 2 is another perspective sectional view of the overvoltage protection device shown in FIG. 1.

As follows further from FIGS. 1 to 3, the overvoltage protection device 1 has a baffle plate 30 which is located at a distance from the ends 9, 10 of the two electrodes 2, 4. The baffle plate 30 is located opposite the peripheral air-breakdown spark gap 6. Not shown is that an ignition spark gap can be accomplished via the baffle plate 30 and one of the electrodes 2, 4. In doing so, the baffle plate 30 forms one ignition electrode while the other ignition electrode is formed by one of the two electrodes 2, 4. The connection of the baffle plate 30 to an ignition circuit can take place via a connection of the ignition circuit to the housing bottom part 19 or the housing cover 20 when they are made of an electrically conductive material, since the baffle plate 30 adjoins both the housing bottom part 19 and also the housing cover 20.

Finally, it follows from FIG. 3 that the overvoltage protection device 1 which is shown is comprised of a very small number of components. The overvoltage protection device 1 can therefore be assembled quickly and easily. First of all, the first insulating part 21 is seated on the pin 25 of the first electrode 2. Then, the housing bottom part 19 and the second insulating part 22 are seated on the pivot 25. The housing bottom part 19 can be seated on the second insulating part 22. To simplify seating, not only of the housing bottom part 19 but also the first insulating part 21 on the second insulating part 22, the second insulating part 22, in the area of the openings 28, 29, has sleeve-like projections 31, 32 on which the housing bottom part 19 and the first insulating part 21 can be seated, and which are aligned with the through openings 16, 17. An assembly comprised of the aforementioned components 21, 19, 22 can be seated on the pin 25 of the first electrode 2 after the corresponding connection of the individual components with one another. Then, the second electrode 4 is inserted. Finally, the housing cover 20 with the baffle plate 30 located therein is seated and joined to the housing bottom part 19.

Figure 6:
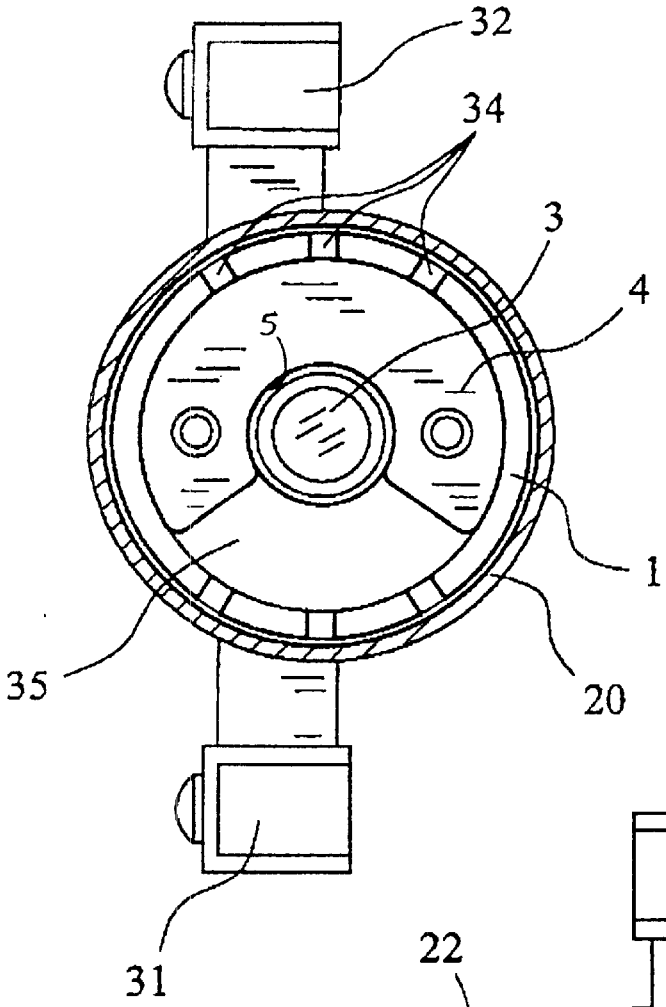
FIG. 6 is an overhead view of a second embodiment of an overvoltage protection device in accordance with the invention in the opened state.
Figure 7:
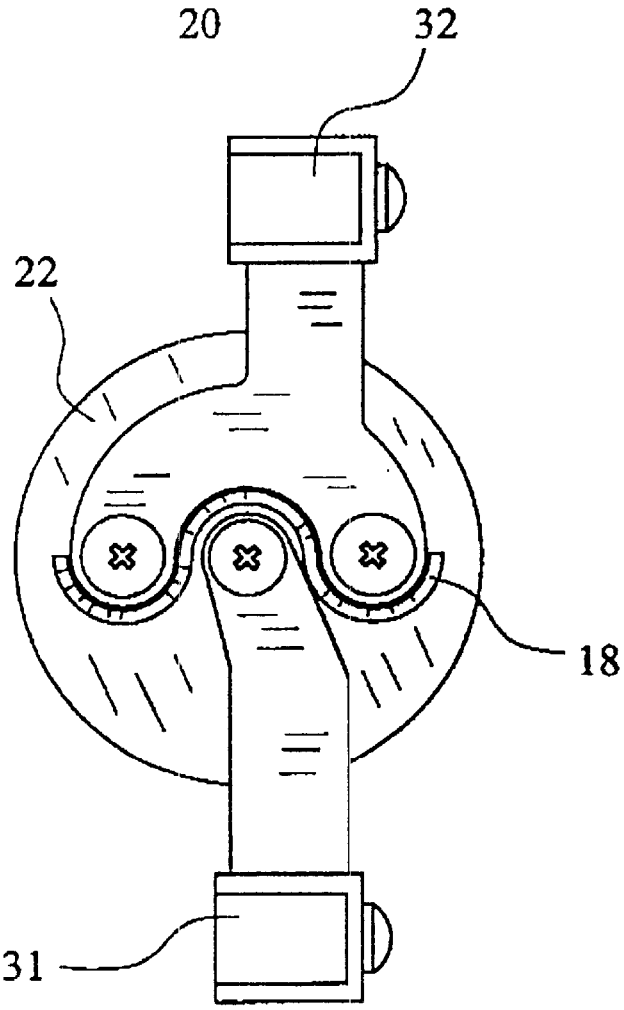
FIG. 7 is a bottom view of the overvoltage protection device as shown in FIG. 6.

While in the embodiment of the overvoltage protection device 1 which is shown in FIGS. 1 to 5, the second arcing horn 5 is ring-shaped, it also applies to the embodiment which is shown in FIGS. 6 and 7 that the second arcing horn 5 is made in the shape of a ring segment; in this embodiment, the second arcing horn 5 extends over an angle of roughly 240°. Because in the embodiment of the overvoltage protection device 1 which is shown in FIGS. 6 and 7, the second arcing horn 5 is not made ring-shaped, but in the shape of only a ring segment, in the second arcing horn 5, viewed in the peripheral direction, an interruption is formed. In other words: in the embodiment as shown in FIGS. 1 to 5, the concentric arrangement of the second arcing horn 5 around the first arcing horn 3 yields a horn spark gap which runs peripherally around the center axis A of the two electrodes 2, 4, especially in a circle or in a ring. Conversely, it applies to the embodiment shown in FIGS. 6 and 7, that the second arcing horn 5 and the first arcing horn 3 form a horn spark gap which runs peripherally around the center axis of the two electrodes 2, 4, but only partially. (It should be pointed out additionally that, in the embodiment as shown in FIGS. 6 and 7, the first arcing horn 3 is made in the shape of a truncated cone in the same way as holds for the embodiment a shown in FIGS. 1 to 5).

While in the.embodiment as shown in FIGS. 1 to 5, the terminal elements which belong to the overvoltage protection device 1 of the invention are not shown, the terminal elements are shown in the embodiment of FIGS. 6 and 7; specifically, a PE terminal element 31 and a potential terminal element 32 are shown. In this embodiment as well, as in the embodiment shown in FIGS. 1 to 5, the two terminal areas 12, 13, and thus, the PE terminal element 31 and the potential terminal element 32, are located on the same side of the overvoltage protection device 1, specifically on the terminal side 14.

Since the two terminal elements are shown in the embodiment of an overvoltage protection device 1 in FIGS. 6 and 7, therefore the PE terminal element 31 and the potential terminal element 32, it can also be taken from FIGS. 6 and 7 that the second arcing horn 5 is aligned with the second terminal area 13, and thus, relative to the potential terminal element 32. In this way, it is also expressed that the area of the second arcing horn 5 which "is not present," i.e., the recess or the interruption, is aligned with the first terminal area 12, and thus, with the PE terminal element 31.

As FIGS. 6 and 7 show, it applies to the embodiment of the overvoltage protection device 1 shown in these figures that the potential terminal element 32 is on the side of the two electrodes 2, 4 which is opposite the PE terminal element 31. Otherwise, FIGS. 6 and 7 show that it holds for the embodiment shown that the two arcing horns 3, 5 are made and arranged symmetrically with reference to the PE terminal element 31; this also applies to the embodiment and arrangement of the potential terminal element 32.

In conjunction with the explanation of the embodiment of an overvoltage protection device 1 in accordance with the invention as shown in FIGS. 1 to 5, it has been pointed out that the housing is sealed in a pressure-tight manner and is filled with an arc extinguishing gas. This does not apply to the embodiment shown in FIGS. 6 and 7. Rather, in this embodiment, the housing 7 is provided with pressure equalization openings. In particular, the housing bottom part 19, on its edge 33 facing the housing cover 20, is provided with radially running slots 34 which act as pressure equalization openings. In addition, there can also be axially running slots (not shown).

Because in the embodiment of a overvoltage protection device 1 which is shown in FIGS. 6 and 7, the second arcing horn 5 is not made ring-shaped, is only a ring segment, there is a free space 35 which is apparent in FIG. 6. In the free space 35, when the overvoltage protection device 1 operates, the plasma generated by the resulting arc can be cooled. The free space 35 is dimensioned such that, in conjunction with the entire cross section of all the slots 34, the "slow" pressure buildup in the free space 35 allows time for the plasma to cool.

We claim:

1. Overvoltage protection device, comprising:

a first electrode which has a first arcing horn, a second electrode which has a second arcing horn, an air-breakdown spark gap between the arcing horns, and a housing which accommodates the electrodes, wherein the arcing horns are shaped and arranged relative to one another such that the arcing horns diverge in a direction from a lower ignition area to outer ends thereof and the air-breakdown spark gap between the arcing horns widens in said direction, wherein the first arcing horn is in the shape of a truncated cone, wherein the second arcing horn is located concentrically around the first arcing horn, and wherein a surface of the second arcing horn facing the first arcing horn is in the shape of a truncated funnel.

2. Overvoltage protection device as claimed in claim 1, wherein the second arcing horn is ring-shaped.

3. Overvoltage protection device as claimed in claim 1, wherein the second arcing horn is in the shape of a ring segment.

4. Overvoltage protection device as claimed in claim 3, wherein the ring segment shape of the second arcing horn extends over an angle of roughly 210° to 270°.

5. Overvoltage protection device as claimed in claim 3, wherein the ring segment shape of the second arcing horn extends over an angle of roughly 240°.

6. Overvoltage protection device as claimed in claim 1, wherein, in the ignition area, between the arcing horns, there is at least one ignition bridge for triggering a creeping discharge.

7. Overvoltage protection device as claimed in claim 6, wherein the ignition bridge is ring-shaped.

8. Overvoltage protection device as claimed in claim 6, wherein the ignition bridge is made of a plastic which evolves an arc-extinguishing gas.

9. Overvoltage protection device as claimed in claim 1, further comprising a first terminal area and a second terminal area; wherein the first terminal area and the second terminal area are located on the same side of the overvoltage protection device.

10. Overvoltage protection device as claimed in claim 9, wherein the electrodes have at least one of holes and through openings in the terminal areas; wherein terminal elements extend from the terminal areas, above and beyond the terminal areas.

11. Overvoltage protection device as claimed in claim 10, wherein the terminal elements comprise a PE terminal element and a potential terminal element.

12. Overvoltage protection device as claimed in claim 11, wherein one of the terminal areas has two terminal possibilities for the potential terminal element.

13. Overvoltage protection device as claimed in claim 9, wherein at least one external projecting bridge is provided in a region between the terminal areas to increase the creepage distance between the terminal areas.

14. Overvoltage protection device as claimed in claim 13, wherein the at least one external projecting bridge has an undulating shape.

15. Overvoltage protection device as claimed in claim 9, wherein the second arcing horn is in the shape of a ring segment and the surface of the second arcing horn facing the first arcing horn is in the shape of a truncated funnel; wherein the second arcing horn is aligned with the second terminal area; and wherein a potential terminal element extends from the second terminal area.

16. Overvoltage protection device as claimed in claim 15, wherein the potential terminal element is on the side of the two electrodes which is opposite that at which a PE terminal element is located.

17. Overvoltage protection device as claimed in claim 16, wherein at least the second electrode and the second arcing horn are shaped and arranged symmetrically with reference to the PE terminal element.

18. Overvoltage protection device as claimed in claim 16, wherein both of the electrodes and both of arcing horns are shaped and arranged symmetrically with reference to the PE terminal element.

19. Overvoltage protection device as claimed in claims 1, wherein the housing is sealed pressure-tight and is filled with an arc extinguishing gas.

20. Overvoltage protection device as claimed in claim 1, wherein the housing has a housing bottom part and a housing cover and the housing bottom part is connected to the housing cover.

21. Overvoltage protection device as claimed in claim 20, wherein the housing bottom part and the housing cover are completely out of contact with the first electrode and the second electrode.

22. Overvoltage protection device as claimed in claim 21, wherein the first electrode and the second electrode are insulated from the housing bottom part and the housing cover by an insulating part.

23. Overvoltage protection device as claimed in claim 22, wherein, in the ignition area, between the arcing horns, there is at least one ignition bridge for triggering a creeping discharge; and wherein the at least one ignition bridge is made in one piece with the insulating part.

24. Overvoltage protection device as claimed in claim 1, further comprising a baffle plate which is located at a distance from the ends of the arcing horns.

25. Overvoltage protection device as claimed in claim 1, wherein in an area of the air-breakdown spark gap and in addition to the air-breakdown gap, an ignition spark gap is provided between an ignition electrode and one of the said first and second electrodes.

26. Overvoltage protection device as claimed in claim 25, wherein the housing is formed of electrically conductive material.

27. Overvoltage protection device as claimed in claim 1, wherein the housing is provided with pressure equalization openings.

28. Overvoltage protection device as claimed in claim 20, wherein at least one of the housing bottom part and the housing cover is provided with radially running slots which act as pressure equalization openings on an edge facing the other of the housing bottom part and the housing cover.

* * * * *